US006923598B2

(12) United States Patent
Vatsvåg

(10) Patent No.: US 6,923,598 B2
(45) Date of Patent: Aug. 2, 2005

(54) METHOD AND APPARATUS FOR THE LIFTING OF OFFSHORE INSTALLATION JACKETS

(76) Inventor: Jan Vatsvåg, Per Spelemannsvei 41, Stavanger (NO), N-4019

( * ) Notice: Subject to any disclaimer, the term of this patent is extended or adjusted under 35 U.S.C. 154(b) by 0 days.

(21) Appl. No.: 10/492,974

(22) PCT Filed: Oct. 16, 2002

(86) PCT No.: PCT/NO02/00374

§ 371 (c)(1),
(2), (4) Date: Apr. 16, 2004

(87) PCT Pub. No.: WO03/033342

PCT Pub. Date: Apr. 24, 2003

(65) Prior Publication Data

US 2004/0258483 A1 Dec. 23, 2004

(30) Foreign Application Priority Data

Oct. 17, 2001 (NO) ..... 20015047

(51) Int. Cl.[7] ..... B63B 35/00
(52) U.S. Cl. ..... 405/203; 405/209
(58) Field of Search ..... 405/195.1, 203, 405/204, 205, 206, 208, 209

(56) References Cited

U.S. PATENT DOCUMENTS

| | | | | |
|---|---|---|---|---|
| 4,683,832 A | | 8/1987 | Dysarz | |
| 4,927,296 A | * | 5/1990 | Kaldenbach | 405/203 |
| 5,097,786 A | | 3/1992 | Sheffield | |
| 6,209,474 B1 | * | 4/2001 | Foss et al. | 114/125 |
| 6,276,875 B1 | | 8/2001 | Gunnar et al. | |
| 6,540,441 B1 | * | 4/2003 | Foss et al. | 405/203 |

* cited by examiner

*Primary Examiner*—Frederick L. Lagman
(74) *Attorney, Agent, or Firm*—Wenderoth, Lind & Ponack, L.L.P.

(57) ABSTRACT

An offshore lifting construction is able to control buoyancy for the lifting of jackets for offshore platforms. The lifting construction is designed such that it can be ballasted for raising and lowering and such that it can take several positions. The lifting construction is designed as an arm equipped with a joint for attachment to a vessel. The arm includes two substantially parallel longitudinal elements with intermediate supporting elements. One of the ends of the arm includes at least two tubular branches substantially perpendicular to the longitudinal direction of the substantially parallel longitudinal elements. At least one of the elements of the arm includes at least one ballastable tank. The arm is equipped with device for attachment to the jacket that is to be lifted. A method for rising jackets or jacket legs for offshore platforms is also described.

10 Claims, 8 Drawing Sheets

METHOD AND APPARATUS FOR THE LIFTING OF OFFSHORE INSTALLATION JACKETS

BACKGROUND OF THE INVENTION

1. Field of the Invention

The invention concerns vessels for lifting heavy loads offshore, and particularly vessels for removing offshore platforms with steel jackets, after the platform deck is removed for instance by means of another lifting vessel. A method for using such vessels is also enclosed.

2. Description of Related Art

As offshore oilfields throughout the world are being depleted, and when further exploitation no longer is profitable, platforms will have to be decommissioned or shut down. It is required from various authorities and international cooperation treaties (OSPAR Convention decision 3/98 and the Guidelines of the Maritime Organization IMO) that all platforms that have been taken out of service, and that can be removed, shall be brought onshore for removal.

On the Ekofisk field alone, soon 15 platforms will be decommissioned and removed. Most of these platforms include a steel jacket on the seabed with a platform deck on top.

The steel jackets are distinguished by being of a truss work design where the weight of the platform is transferred through the legs of the jacket down to the seabed, and from there further down through poles. These designs or constructions are relatively weak in a transversal direction and do not have sufficient strength to transfer its own weight without many supporting points, localized on the joints or nodes between the legs and the transversal supports. Typical for these constructions are 4 to 12 legs with a weight of up to 20,000 tons.

A conventional method for the installation of such jackets is that these are laid horizontally on a barge carrier and thereafter either lifted or pushed into the sea, rotated vertically, and lowered down to the seabed by means of a crane vessel rotating the jacket vertically before being lowered to the seabed. If the jacket is too heavy, the filling of buoyancy tanks is used as a supplementary aid. During removal, this sequence can be reversed. However, it is a problem that such jackets frequently are difficult to turn, and this means that they often have to be cut into smaller parts for transport to the shore. The conventional lifting vessels have a limited lifting capacity, and the use of such requires a lot of under water work. This work can include installation of new lifting lugs, cutting off legs and crossbeams and possibly the use of buoyancy tanks either alone or in combination with a lifting vessel. Transferring the jacket to a barge for transport to the shore also requires calm weather conditions with low wave heights, something that possibly lengthens these operations and thereby makes them more financially demanding.

Other vessels of various designs have been suggested to simplify these operations.

Norwegian Patent Application 1996 5439 shows a transporting device for the installation and removal of platform underframes or jackets. The application shows that the transporting device is an elongated construction with floating elements that can be ballasted such that the transporting device takes a substantially vertical position in the sea. The transporting device is then led towards the jacket that is to be lifted, and is secured to a sliding saddle on the transporting device. The transporting device is then deballasted such that it is lifted along with the jacket to a substantially horizontal position.

U.S. Pat. No. 4,651,667 shows a pivoted barge for the towing and launching of offshore constructions. A joint pivots as the construction, that is to be launched, is displaced along with its center of gravity and results in a pivoting movement of the joint.

The building of new vessels is however fairly expensive and necessitates many marine systems in addition to fabrication of steel material. At the same time there are a large number of vessels tied up waiting for work. These may already be equipped with systems for safety, ballasting, mooring, towing and propulsion in addition to accommodation, cantinas and large deck areas. These systems have also been tested, certified and used. By attaching a lifting structure to an existing vessel, the expenses for a lifting or decommissioning vessel is considerably reduced. It is expected that an amount of between 5,000 and 10,000 tons of new steel can be saved. Such existing vessels can be fairly inexpensive, for instance due to the present situation in the North Sea. The integration between the existing and the new constructions can be kept to a minimum to control the expenses. Making a lifting construction suited for connection to different vessels makes it possible to keep the day rates to a minimum. By integrating these additional services in the lifting vessel, the need for additional vessels during the preparation offshore will be limited.

SUMMARY OF THE INVENTION

Accordingly the present invention concerns an offshore lifting construction with means for controllable buoyancy for the lifting of jackets or jacket legs for offshore platforms, where the lifting construction is designed such that it can be ballasted to be raised or lowered, and such that it can take a substantially horizontal raised position, and a substantially vertical lowered position. The lifting construction is designed as an arm or frame equipped with means for pivotal attachment to a vessel. The arm comprises two ends and at least two substantially parallel elongated members with intermediate support members or beams. One of the ends of the arm includes at least two substantially parallel elements or branches substantially perpendicular to the longitudinal direction of the substantially parallel elongated elements. These elements may be tubular. At least one of the elements of the arm includes at least one ballastable tank. The arm is equipped with means for securing the jacket that is to be lifted.

Furthermore, the invention describes a method for the raising of jackets or jacket legs for offshore platforms with the apparatus described above. The method includes the steps described below. The vessel with the arm is navigated to the jacket of the offshore installation that is to be removed. The arm is ballasted by filling the ballast tanks in the arm with sea water, such that the arm sinks and is pivoted around the joint, with a sequence in relation to the various ballast tanks such that the lowering is performed without the joint or the vessels being loaded beyond certain limits, to a lowered, substantially vertical position. The jacket is placed between the two branches. The jacket is secured with means for securing the jacket that is to be lifted, to the arm. The ballast tanks are then deballasted such that the arm is pivoted along with the jacket about the joint until the arm is substantially horizontal and the jacket is raised.

The arm of the invention is designed with two elongated tubes, preferably of steel, with beams in between. At the end of the arm there are two tubes or branches substantially perpendicular to the longitudinal direction of the arm. The arm can be water tight to make it buoyant, and is divided into several tanks that can be filled or emptied with ballast water. The arm is adapted to be secured to a vessel in a joint with the ability to rotate in a vertical plane (as compared to a thwart ship axis). This joint can alternatively be a spherical joint with a rotation additionally about the two other axis's (longitudinal and vertical) and if it is adequate buoyancy in the arm, the joint can slide in a vertical direction.

The branches are preferably adapted to provide sufficient buoyancy with a predetermined point of application, they are placed with an interrelated distance such that the jacket can be provided between the branches and they can serve as a support for the jacket. Alternatively, the internal distance between the branches can be adjusted to be adapted to the lifting of jackets of various dimensions.

The intermediate supporting elements or beams on the arm, can form or be included with supporting points or cradles that are adapted to lie alongside the jacket legs. The beams, the supporting points or the cradles are preferably adjustable such that they can be adjusted against the strong points of jackets of various sizes. The jacket can be secured to the arm in various ways, such as clamping, tack welding, strapping and bolting, but preferably the legs resting towards the frame are secured to the top point against a construction or arrangement at the top of the arm. This construction can include winches with wires that are secured to the jacket, and can be adapted to lift the jacket somewhat. This lifting is particularly useful during the first part of the raising or the last part of a launching when the jacket is to be lifted from, or attached to, a foundation on the seabed. This lifting can alternatively be performed with hydraulic cylinders between the arm and the jacket.

The vessel must be deballasted to compensate for the weight of the jacket that is transferred through the arm and the supporting joint. At the same time, it is important to empty the buoyancy tanks enabling the arm to rotate towards a horizontal position.

The jacket legs that are to be removed must be detached or cut off at the seabed before they can be removed. In the event of an upper platform on the jacket, this must also be removed before the jacket can be lifted.

By filling ballast in the tanks, the arm will rotate to a vertical position. The vessel and the arm is then led in towards the jacket such that the arm is lying towards the jacket. The beams on the arm, the supporting points or cradles that are to be lying alongside the legs (the jacket legs) are in advance adjusted such that they rest against the strong points of the jacket, and are adjusted in relation to these.

The load on the construction at the top of the arm is reduced as the weight of the jacket is transferred to the arm. At the end, the jacket will lie on the arm in a substantially horizontal position. The lifting construction according to the invention is built with sufficient strength and buoyancy to lift platform jackets.

Vessels that can be used in connection with a lifting construction or arm according to the invention, can include vessels for drilling, accommodation, barges, semi-submersible vessels, vessels for particular purposes, supply vessels, etc. If a barge is used, this will be secured through the joint. The joint can then be secured in a skidding shoe that can skid along a skidding rail. The skidding rail can be designed such that the skidding shoe not can be lifted up and out of the rail during operation. The skidding shoe can also alternatively be temporarily locked against horizontal motion. This can be performed by means of a locking plate/bolt arrangement. The joint can include a bolt going through a bearing that is secured to, or forms a part of, the skidding shoe and the arm.

The arm can then be designed to enable it to be drawn over the barge by means of winches. It can, for instance, be two winches installed at the front part of the barge deck, one on the starboard and one on the port side. When the arm is to be drawn over the barge, the wires are secured to the front part of the arm, the locking arrangement for the skidding is released, and the skidding operation can begin. Alternatively, the devices can be used to lead the arm over the barge. These devices may include hydraulic cylinders or rack and pinion systems.

The arm may then be filled with ballast such that it steadily lies towards the barge before the arm and the jacket is secured. Other methods for securing the arm and the jacket must be evaluated depending on weather conditions, distance to shore, etc.

If a different lifting vessel is used, where the arm cannot be pulled over the vessel, the jacket will float on the lifting arm that is secured to the vessel for transport to shore. In this case, the skidding equipment is not necessary.

The ballast system is designed such that each tank can be filled and emptied separately. Ballasting is performed by means of submerged pumps or pressurized air. Pumps and valves are controlled from the vessel, and alternatively from a supporting vessel. Ballasting should preferably be performed such that a controlled load is applied to the joint and such that it is ensured that the arm is pivoting in the right direction as compared to the vessel during rising. The branches could for instance, during rising, be ballasted first, such that the point of attack or point of application of the buoyancy creates a rotating force or moment about the joint such that the arm is turned the correct way during rising. When the arm has turned a certain angle as compared to the horizontal in this way, ballast tanks in a lower tubular transversal section can be emptied, succeeding emptying of the ballast tanks in the longitudinal tubes.

The jacket can be shipped onshore with trailers. The vessel can be moored with the bow towards a quay with the deck in the same height as the quay. The trailer can be placed below the beams on the arm. The beams can then be led to or from the arm before the trailers lift the beams with the jacket on or off.

The advantages with the invention is that it results in a low fabrication cost, no activities under water, except for cutting off or in any other way releasing the jacket from the foundation, and securing the jacket above the waterline. The invention can be adapted to all steel jackets, be secured to all barge sizes, and does not normally require being adapted to different barges, with possibly the exception of the pivoting joint, where the skidding rail must be installed. This results in a quick, simple, safe and thereby cost effective removal method, with a simple unloading.

DETAILED DESCRIPTION OF THE INVENTION

Figure 1:
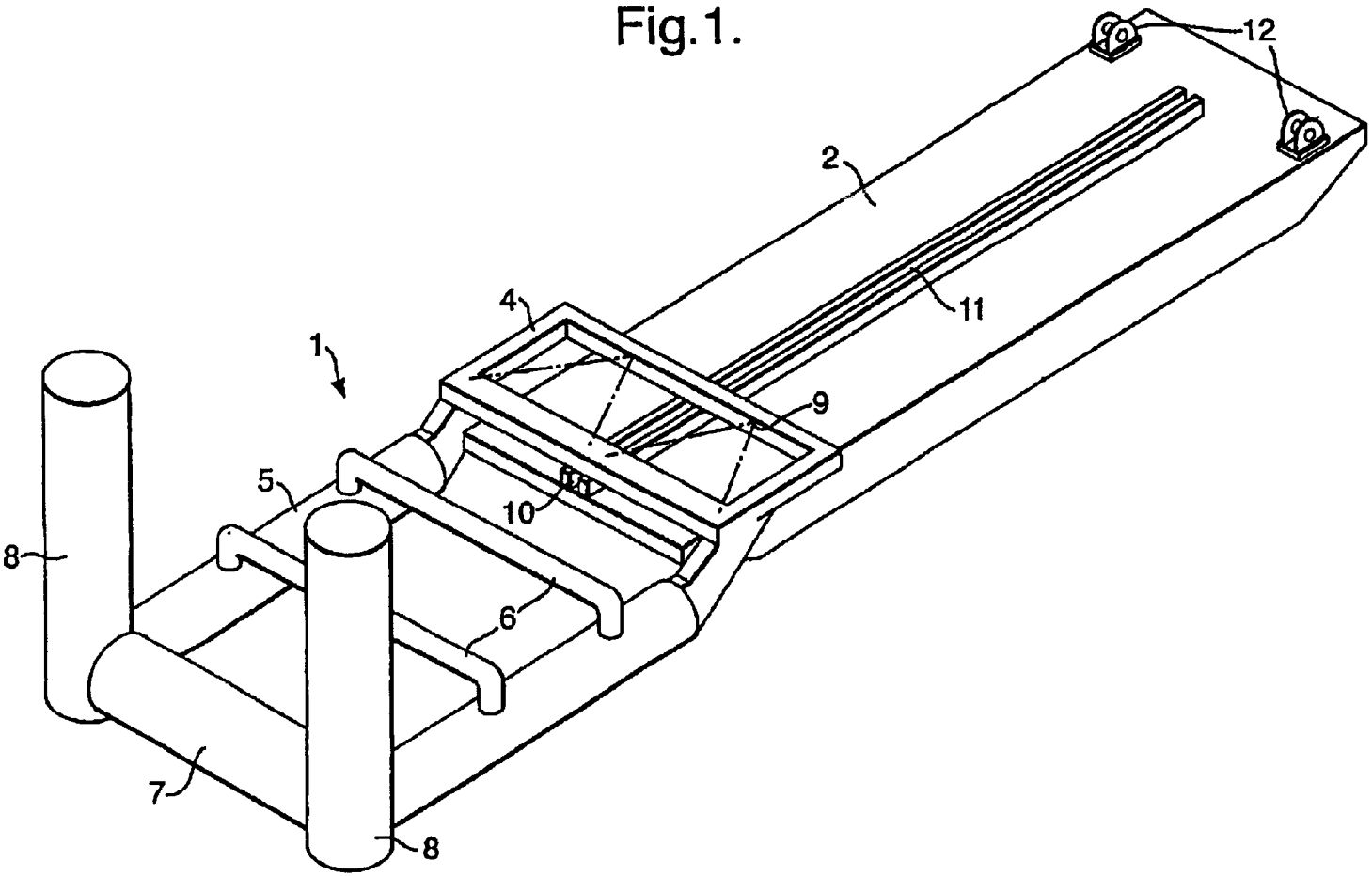
FIG. 1 shows a perspective view of one embodiment of an offshore lifting construction according to the invention, attached to a barge, where the lifting construction lies in a substantially horizontal position.

FIG. 1 to FIG. 4 shows an embodiment of an offshore lifting construction or arm (1) according to the invention. The figures show various phases of a lifting process. The lifting construction is shown attached to a barge (2). The lifting construction is designed with two substantially parallel longitudinal elements or tubes (5), between, on the upper part of the lifting construction provided, a frame (4) with a holding arrangement (9) for the jacket that is to be lifted, two intermediate supporting elements or beams (6), a lower tubular transversal unit (7) and a joint (10) for attachment to the barge (2). On the lower part of the two substantially parallel longitudinal elements (5), two tubular elements or branches (8) are provided substantially perpendicular to the longitudinal direction of the substantially parallel longitudinal elements (5). The barge is equipped with a skidding rail (11) and winches (12). The joint (10) (shown on FIG. 1 and FIG. 11) is skiddingly connected to the skidding rail (11).

The elements of the lifting construction (1) form or comprise internal ballast tanks (not shown) that can be ballasted by pumps for instance on the barge, in the lifting construction, or on a supporting vessel. The ballast tanks are preferably placed several places in the arm (1) such that the size and the point of application of the buoyancy can be controlled.

On FIG. 1 it is shown that the lifting construction (1) lies in a substantially horizontal position and creates an elongation of the barge (2).

Figure 2:
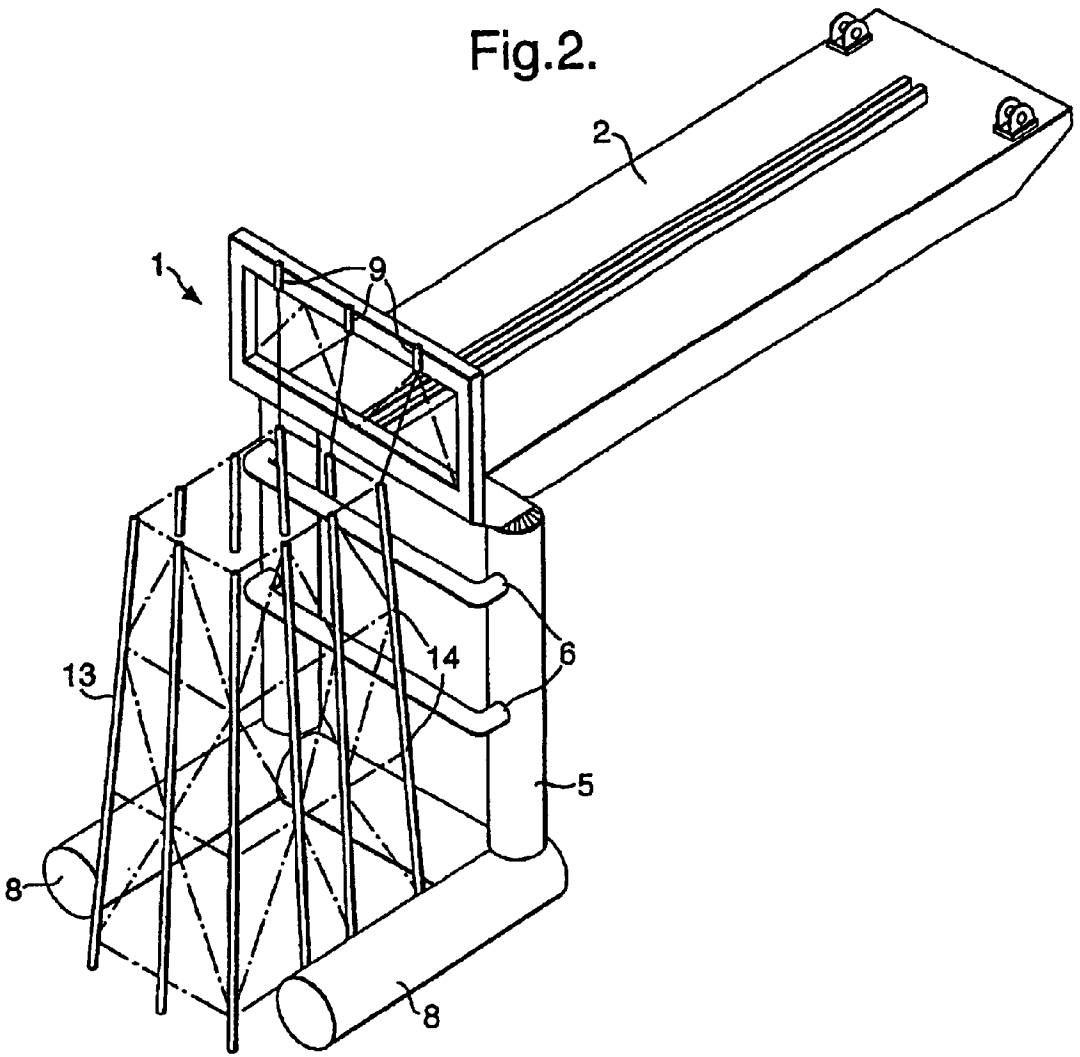
FIG. 2 shows a perspective view of the embodiment shown on FIG. 1, in a substantially vertical position, secured to a steel jacket that is to be raised.

From FIG. 2, it is shown that the lifting construction (1) is ballasted and is thereby turned or pivoted about joint (10) (shown on FIG. 1 and FIG. 11) and is lowered to a substantially vertical position. The lifting construction (1) and the barge (2) is maneuvered against a jacket (13) that is to be lifted. The jacket (13) that is to be lifted is shown secured to the holding arrangement (9). The jacket is placed between the branches (8) on the lower part of the two substantially parallel longitudinal elements (5). The two intermediate supporting elements (6) may be adjustable or include adjustable supporting points (not shown) that can be adjusted such that they can rest against strong points (14) on the jacket (13) that is to be lifted. The holding arrangement (9) includes winches that can pull the jacket (13).

Figure 3:
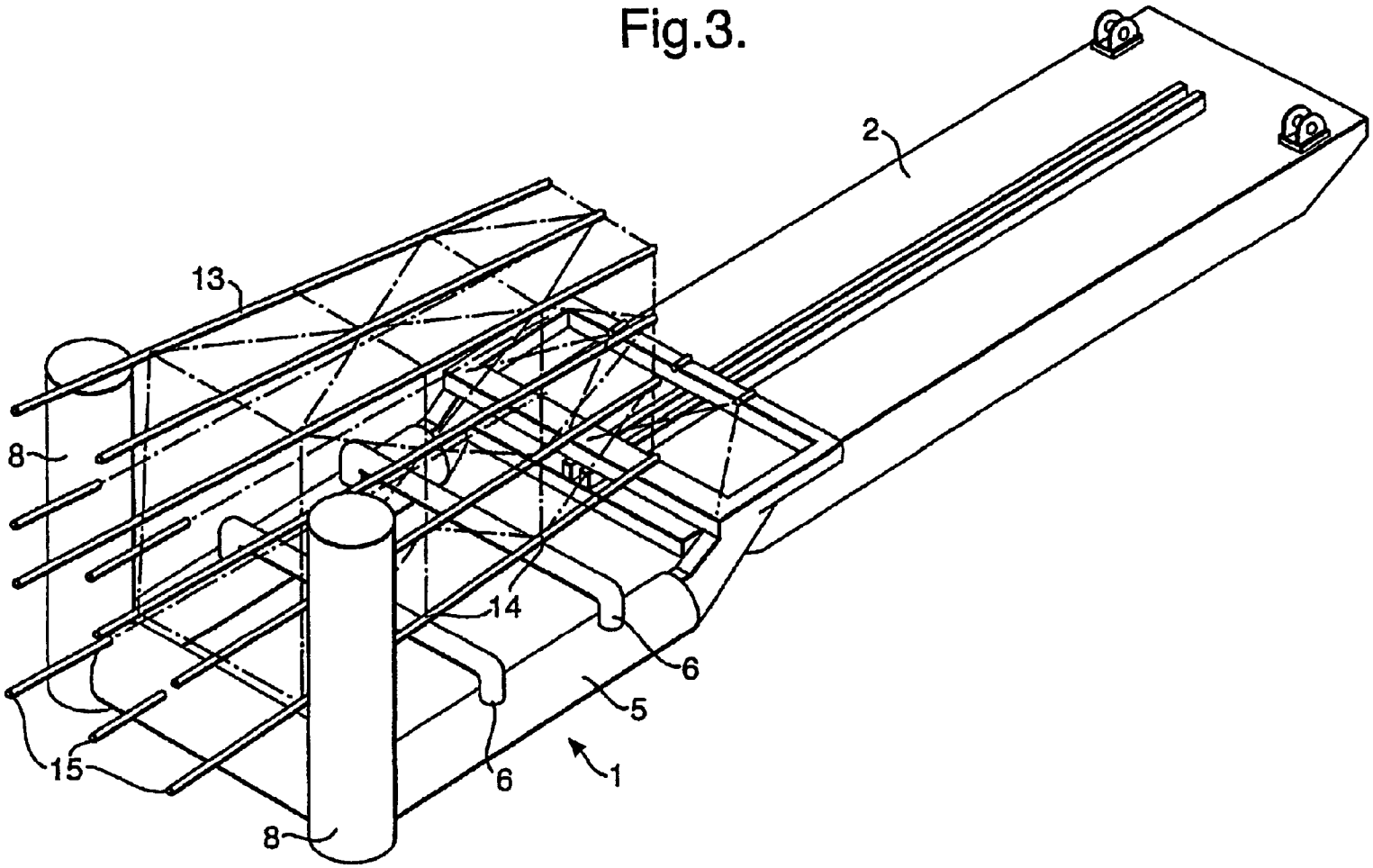
FIG. 3 shows a perspective view of the embodiment shown on FIG. 1, in a substantially horizontal position, secured to a steel jacket that has been raised.

From FIG. 3, it is shown that the lifting construction (1) is deballasted and is thereby pivoted about the joint (10). The legs (15) of the jacket (13) are cut off or in any other way released from its foundations at the seabed. The jacket (13) and the lifting construction (1) lies substantially parallel to the barge (2).

Figure 4:
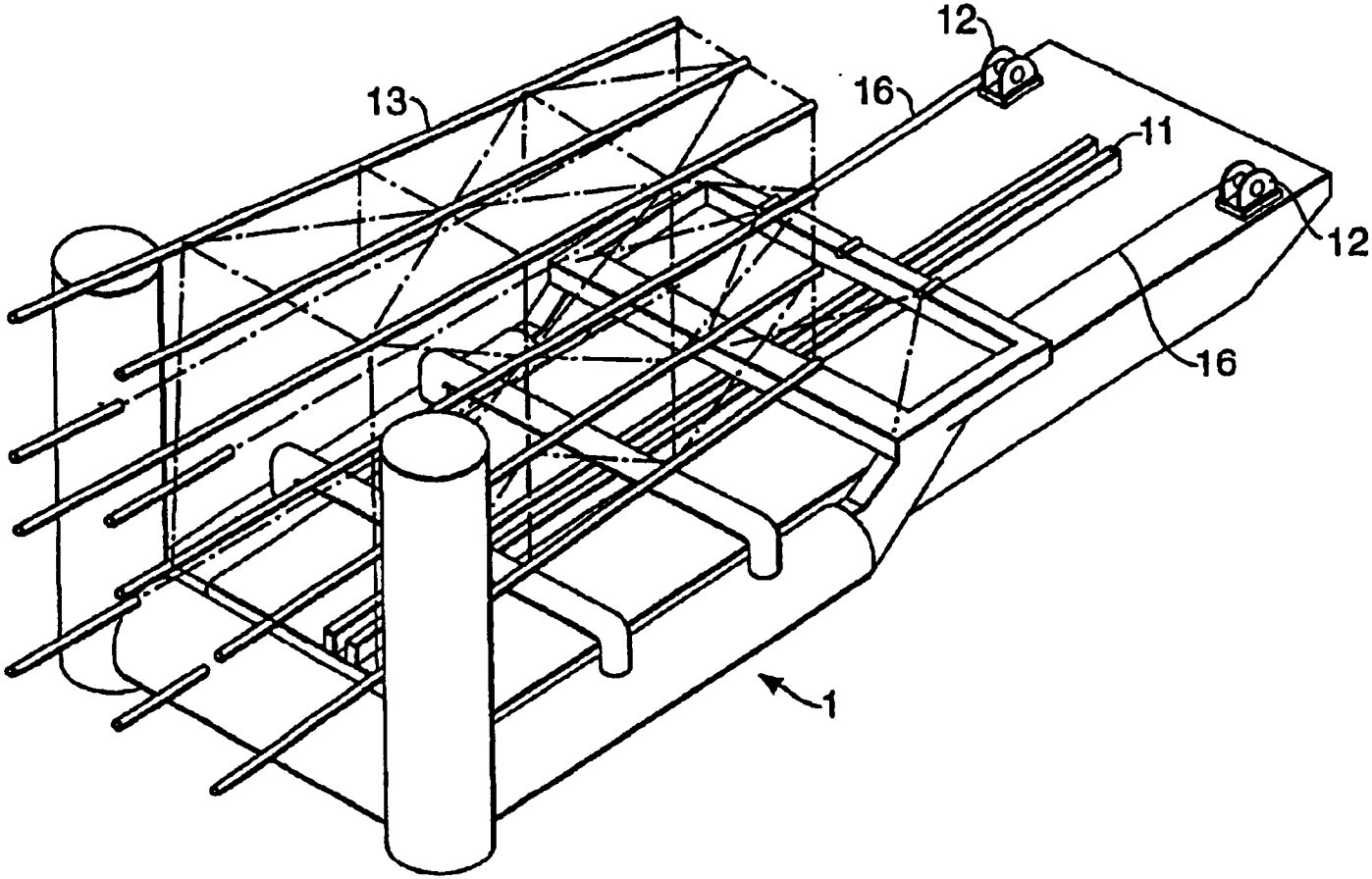
FIG. 4 shows a perspective view of the embodiment shown on FIG. 1, in a substantially horizontal position, secured to a steel jacket that is raised, where the barge is led in under the lifting construction.

From FIG. 4, it is shown that the lifting construction (1) along with the jacket (13) is led over the barge (2). The barge (2) is led under the lifting construction (1) by pulling the barge (2) in below the arm (1) by means of the winches (12) with wires (16) secured to the lifting construction (1), such that the joint (10) has skidded along the skidding rail during the guidance of the barge (2) under the arm (1). In this embodiment the arm (1) is secured with a joint (18) to a vessel (3) with a u-shaped bow section. The vessel (3) can be a semi submergible vessel. The u-shaped end may be an integrated part of a vessel, or constitute a module attached to another vessel. The construction can include holding elements (not shown) to hold the arm (1) attached to the vessel (3) when this is raised or, in other positions, if required.

The next embodiment is shown with three intermediate supporting elements (6) that are adjustable or includes adjustable supporting points (not shown) that can be adjusted to lie against strong points (14) on the jacket that is to be lifted.

Figure 5:
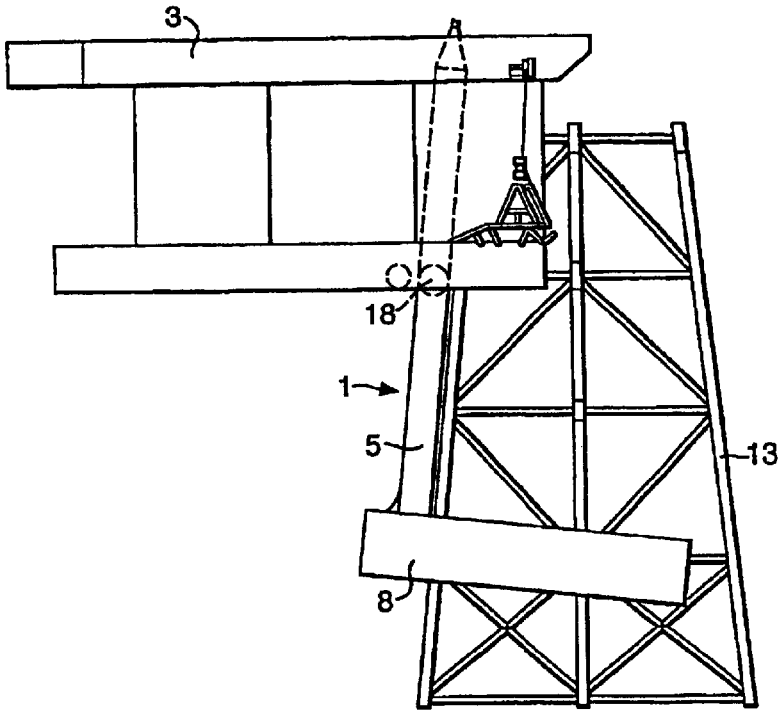
FIG. 5 shows a side elevation of another embodiment of an offshore lifting construction according to the invention, attached to a vessel with a unshaped end section, where the lifting construction lies in a substantially vertical position secured to a steel jacket that is to be raised or lowered.

FIG. 5 shows a side elevation where the arm (1) is ballasted and is thereby pivoted about a joint (18) and is lowered to a substantially vertical position. The lifting construction (1) and the barge (2) are maneuvered against the jacket (13) that is to be lifted. The jacket (13) is also here placed between the branches (8) on the lower part of the two substantially parallel longitudinal elements (5).

Figure 6:
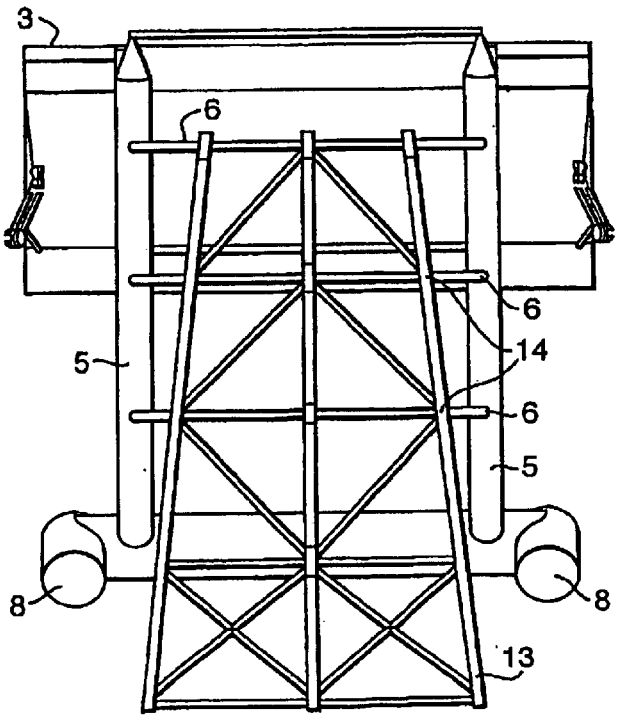
FIG. 6 shows a front elevation of FIG. 5.

FIG. 6 is a front elevation of FIG. 5 where the three intermediate supporting elements (6) are adjusted or in any other way placed such that they rest against strong points (14) on the jacket that is to be lifted.

Figure 7:
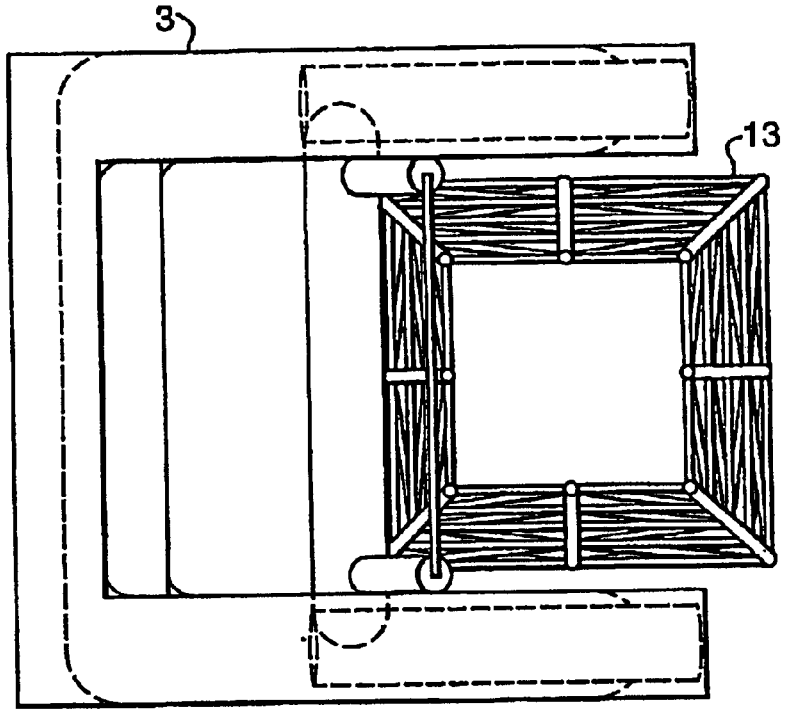
FIG. 7 shows a top elevation of FIG. 5.

FIG. 7 shows a top elevation of FIG. 5 where the u-shaped bow section of the vessel is clearly shown.

Figure 8:
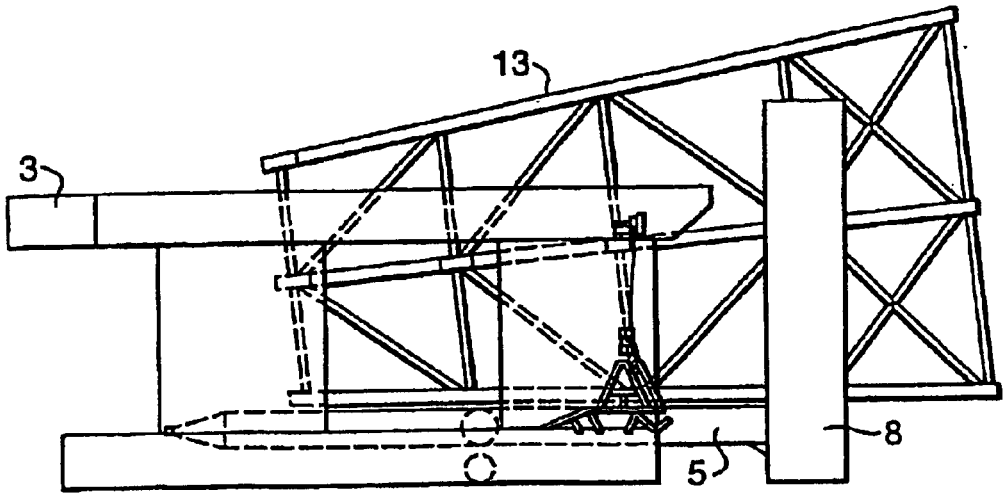
FIG. 8 shows a side elevation of the embodiment shown FIG. 5, but where the lifting construction lies in a substantially horizontal position.

FIG. 8 is a side elevation of the embodiment on FIG. 5, but where the lifting construction (1) is deballasted and is pivoted to a substantially horizontal position.

Figure 9:
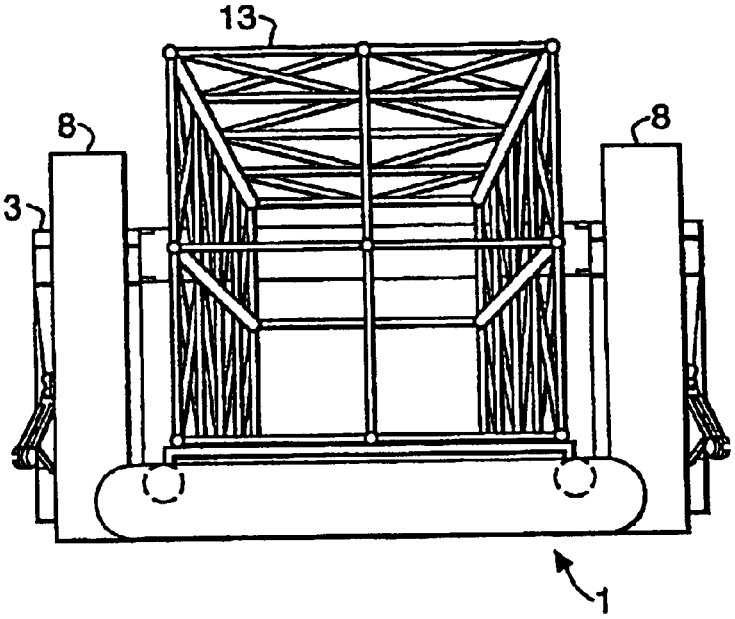
FIG. 9 shows a front elevation of FIG. 8.

FIG. 9 shows a front elevation of FIG. 8 where the jacket (13) is partly placed inside the u-shaped bow section.

Figure 10:
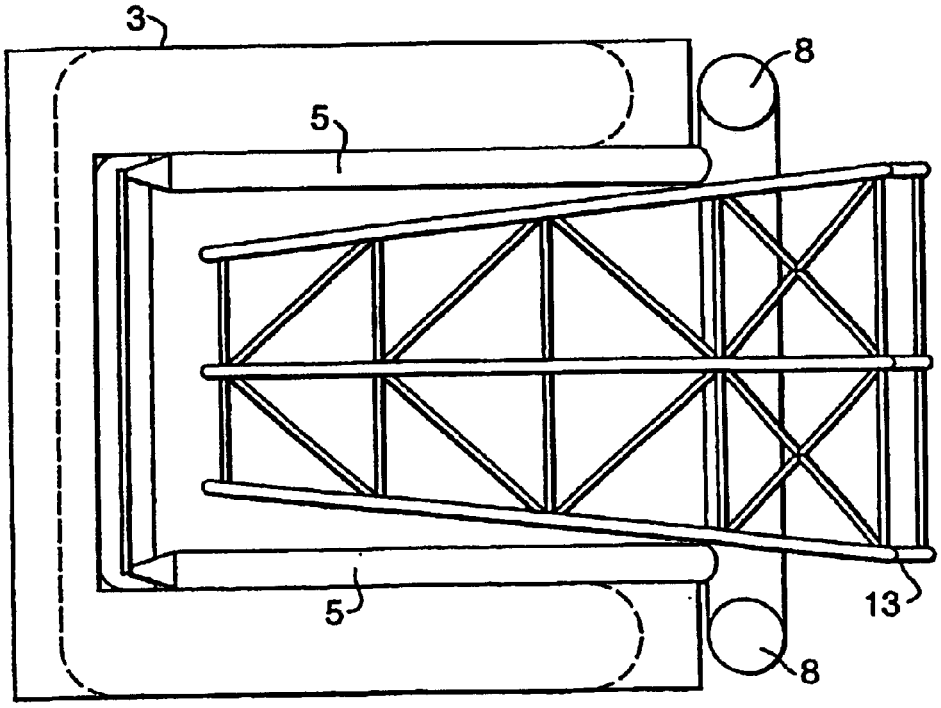
FIG. 10 shows a top elevation of FIG. 8.

FIG. 10 shows a top elevation of FIG. 8.

Figure 11:
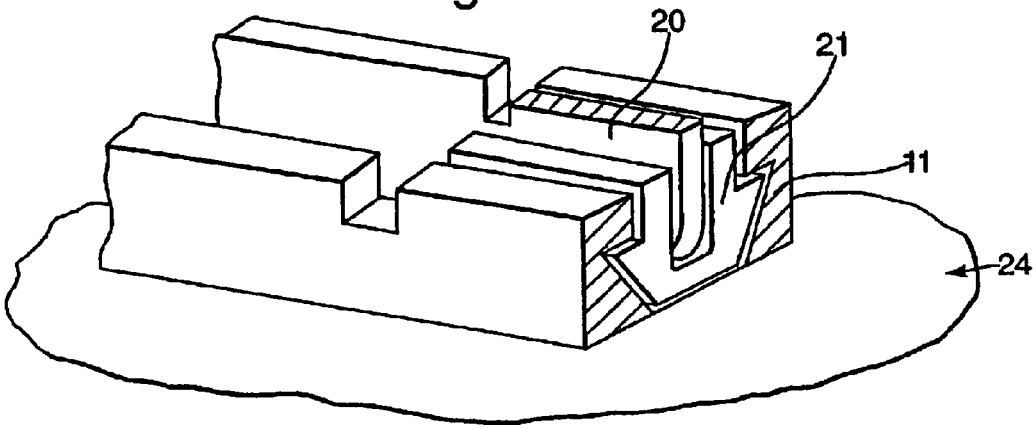
FIG. 11 shows a perspective view of a detail of a joint between a barge and a lifting construction according to the invention.
Figure 12:
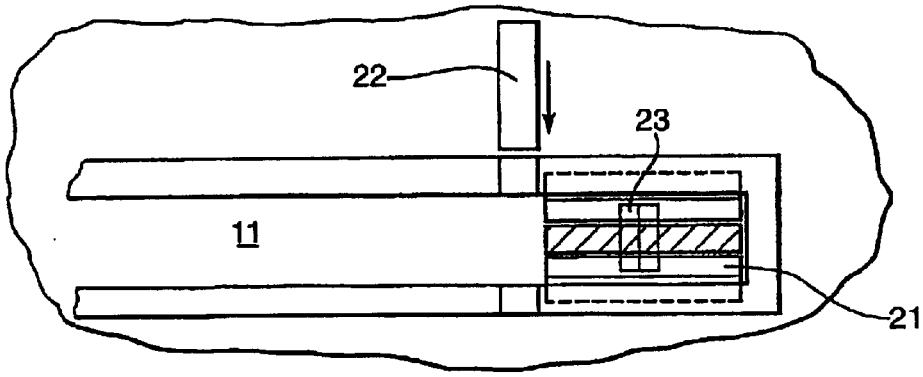
FIG. 12 shows a top elevation of the details on FIG. 11.

FIG. 11 and FIG. 12 show an embodiment of the joint (10) between the barge (2) and the lifting construction (1) according to the invention. On the figures it is shown that the joint is placed in the skidding rail (11) attached to the deck (24). The joint comprises a plate (20) that is secured to the arm (1) that is pivotally secured to a skidding shoe (21) that again is skiddingly or glidingly attached in the skidding rail (11). The joint (10) is shown with a bolt/bearing assembly (23). The skidding shoe (21) can be locked to the skidding rail (11) by means of a locking device (22).

A method for the use of the arm (1) according to the invention as shown on FIG. 1 to FIG. 4 includes to guide the barge (2), with the arm (1), to a jacket on an offshore installation (13) that is to be removed. The arm (1) is then ballasted, preferably by filling ballast tanks (not shown) in the arm (1) with sea water, such that the arm (1) sinks and pivots about the joint (10). The ballasting can be performed by letting valves in the arm open, or that water is pumped into the ballast tanks with suitable pumps. The ballasting is preferably performed in a sequence in relation to the various ballast tanks such that the lowering can be performed with a controlled load on the joint (10) or the barge (2).

When the arm (1) is lowered to a vertical position (FIG. 2), the jacket (9) is placed between the two branches (8) and is secured with a holding arrangement (9) to the arm (1). The jacket (13) is then released from its foundations (not shown). The intermediate supporting elements (6) are adjusted, or are adjusted in advance, to bear against strong points (14) on the jacket (13).

Subsequently the ballast tanks are deballasted such that the arm (1) pivots along with the jacket (13) about the joint (10). The ballasting is preferably performed sequentially such that the point of application of the buoyancy is placed such that the arm pivots about the joint (10) without any unwanted forces being applied. The pivoting movement is continued until the arm (1) is substantially placed horizontally as an elongation of the barge (2), as shown on the FIG. 3.

The barge (2) is then pulled in below the arm (1) by means of winches (12) and wires (16) as shown on FIG. 4. The arm (1) is then ballasted or secured to the barge (2) such that these are stably placed in relation to each other. The barge (2) with the arm (1) and the jacket (13) can then be moved to a suitable place.

A method for using the embodiment shown on FIG. 5 to FIG. 10 has many common features with the method as described above, but the arm (1) is placed on a vessel (3) with a u-shaped end and is instead pivoting about a joint (18) placed between the arm (1) and the u-shaped end. During ballasting and deballasting, as described for the embodiments on FIG. 1 to FIG. 4, the arm will pivot about a joint (18). If the vessel is semi-submergible, it can be adjusted in terms of its position in the water to adjust the distance between the supporting elements (6) and the strong points (14) on the jacket (13), and to participate is during raising or lowering of the jacket (13) and the arm (1).

Alternatively this method can be reversed for the launching of installations.

The present application is not intended to be limited to the embodiments described above, and shall only be considered limited by the enclosed claims.

What is claimed is:

1. An offshore lifting construction for the lifting of jackets or jacket legs for offshore platforms, the lifting construction comprising:

a frame with means for ballasting for raising and lowering the frame, the frame being adapted to take a substantially horizontal raised position and a substantially vertical submerged position in relation to a water surface where a jacket is placed, and including a lower end and an upper end and at least two, in a longitudinal direction of the frame, substantially parallel first longitudinal elements with intermediate supporting elements for the jacket, and the frame being equipped with means for attachment of the jacket that is to be lifted, wherein the frame has a lower tubular transversal unit located at a bottom of the lower end of the frame;

the frame includes means for pivotal attachment to a vessel;

the lower end of the frame includes at least two substantially parallel second longitudinal elements, each having one free end and one end attached to the lower end of the frame, the at least two substantially parallel second longitudinal elements being substantially perpendicular with the substantially parallel first longitudinal elements and a longitudinal direction of the lower tubular transversal unit, such that the at least two second longitudinal elements and the lower tubular transversal unit are adapted for placing the jacket therebetween during lifting;

the substantially parallel first longitudinal elements, the lower tubular transversal unit and the two substantially parallel second longitudinal elements include separate internal ballast tanks; and the frame includes a second frame having the means for attachment of the jacket that is to be lifted arranged at the upper end of the frame, and fixed between the substantially parallel first longitudinal elements.

2. An offshore lifting construction according to claim 1, where the means for attachment of the jacket that is to be lifted includes winches for raising the jacket in relation to the frame.

3. An offshore lifting construction according to claim 1, wherein the means for attachment of the jacket that is to be lifted includes a passive wire system and deballasting alone is used for the lifting.

4. An offshore lifting construction according to claim 1, wherein the frame is adapted to be led over the vessel.

5. An offshore lifting construction according to claim 4, wherein the vessel comprises winches with wires adapted to pull the frame over the vessel.

6. An offshore lifting construction according to claim 4, wherein the vessel includes a skidding rail to lead the frame over the vessel.

7. An offshore lifting construction according to claim 4, wherein the means for pivotable attachment to the vessel comprises a plate secured to the frame, a skidding shoe pivotably attached to the plate, and a locking device for securing the skidding shoe to the skidding rail where the skidding shoe is glidingly connected to the skidding rail.

8. An offshore lifting construction according to claim 1, wherein at least one of the intermediate supporting elements can be adjusted in relation to the longitudinal direction of the frame such that the at least one of the intermediate supporting elements can be directed towards strong points on the jacket that is to be lifted.

9. A method for raising jackets or jacket legs for offshore platforms by means of an offshore lifting construction according to claim 1, the method comprising:

leading the vessel with the frame to the jacket of an offshore installation that is to be removed;

ballasting the frame by filling the ballast tanks in the frame with sea water, in a sequence in relation to the various ballast tanks such that submersion is performed with a load on the means for pivotal attachment and the vessel within predetermined limits, such that the frame sinks and pivots about the means for pivotal attachment to a submerged substantially vertical position;

placing the jacket between the at least two substantially parallel second longitudinal elements;

securing the jacket with the means for attachment of the jacket to the frame; and deballasting the ballast tanks such that the frame is pivoted along with the jacket about the means for pivotal attachement until the frame lies substantially horizontal and the jacket is raised.

10. A method according to claim 9, wherein the frame is adapted to be led over the vessel, the vessel comprises winches with wires adapted to pull the frame over the vessel and a skidding rail for guiding the frame over the vessel, and the method further comprises:

pulling the vessel in below the frame by means of the winches and the wires.

* * * * *